US006740026B2

(12) United States Patent
Samways

(10) Patent No.: US 6,740,026 B2
(45) Date of Patent: May 25, 2004

(54) CENTRIFUGAL SEPARATOR WITH AN ARRANGEMENT FOR HINDERING INADVERTENT COVER REMOVAL

(75) Inventor: Andrew Samways, Dorchester (GB)

(73) Assignee: Filterwerk Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 10/024,573

(22) Filed: Dec. 21, 2001

(65) Prior Publication Data

US 2002/0119882 A1 Aug. 29, 2002

Related U.S. Application Data

(63) Continuation of application No. PCT/GB00/02023, filed on May 25, 2000.

(30) Foreign Application Priority Data

Jun. 23, 1999 (GB) ..... 9914640

(51) Int. Cl.[7] ..... B04B 7/06; B04B 9/06
(52) U.S. Cl. ..... 494/12; 494/49; 494/60
(58) Field of Search ..... 494/1, 10, 12, 494/24, 36, 43, 49, 60, 64, 65, 67, 84, 901; 210/168, 171, 232, 360.1, 380.1, 416.5; 184/6.24

(56) References Cited

U.S. PATENT DOCUMENTS 2,321,144 A * 6/1943 Jones
2,335,420 A * 11/1943 Jones
4,226,669 A 10/1980 Vilardi
5,665,047 A * 9/1997 Brimhall
5,785,849 A * 7/1998 Mules
5,855,773 A 1/1999 Lasota
5,906,733 A * 5/1999 Purvey
6,074,336 A 6/2000 Purvey
6,224,531 B1 * 5/2001 Frehland et al.

FOREIGN PATENT DOCUMENTS

| | | |
|---|---|---|
| DE | 3308368 | 4/1984 |
| EP | 0081874 | 6/1983 |
| GB | 2204510 | * 11/1988 |
| GB | 2311239 | 9/1997 |
| JP | 10337502 | 12/1998 |

* cited by examiner

*Primary Examiner*—Charles E. Cooley
(74) *Attorney, Agent, or Firm*—Crowell & Moring LLP

(57) ABSTRACT

A centrifugal separator (10) for an engine includes a rotor (30) mounted within a housing (12, 14) for rotation on hollow spindle (42) to the end of which oil is supplied at high pressure to enter the rotor. To prevent the rotor from flying from the base and oil spraying if the cover (14) is removed without shutting off the oil supply via optional valve (80), a rotor restraint (90) is provided in the form of a ring (91) which surrounds and overlies a flange of the rotor. The ring may be complete or discontinuous and may also include an interlock to prevent attachment of the cover and/or supply of oil if the ring is not in place.

12 Claims, 2 Drawing Sheets

CENTRIFUGAL SEPARATOR WITH AN ARRANGEMENT FOR HINDERING INADVERTENT COVER REMOVAL

CROSS REFERENCE TO RELATED APPLICATIONS

This application is a continuation of international patent application no. PCT/GB00/02023, filed May 25, 2000 designating the United States of America, the entire disclosure of which is incorporated herein by reference. Priority is claimed based on United Kingdom patent application no. GB 9914610.9, filed Jun. 23, 1999.

BACKGROUND OF THE INVENTION

This invention relates to centrifugal separators for separating solid contaminants from a liquid supplied thereto at elevated pressure and in particular relates to operating and maintaining such a centrifugal separator with respect to a machine in which said liquid is contained and flows.

United Kingdom patent specification no. GB-A-2311239 describes a self-powered centrifugal separator, that is, one having a separation rotor which is rotated by the pressure of the liquid supplied to and cleaned thereby, having such a separator rotor contained in a housing defined by separable base and cover parts and discusses the potential problems of inadvertent removal of the cover from the base. The patent specification proposes the inclusion of valve means to divert the elevated pressure supply within the separator to permit such removal without interrupting the supply per se and, also, the provision of a mechanical interlock between a manually operated handle of the valve means and the housing cover which impedes said removal until the valve means is operated to divert the liquid supply from the separation rotor.

As discussed therein, it is a feature of that and other designs of centrifugal separator that the liquid is supplied at elevated pressure to the separation rotor through an axle on which the rotor is mounted for rotation and which axle is disposed between the base and usually also the cover.

The supply is often arranged to exert an axial force on the rotor to overcome gravity so that the cover not only defines a housing to contain liquid discharged from the rotor but also serves to constrain/retain the rotor axially when supplied with liquid and subjected to such axial force.

It has been found that inadvertent removal of the cover without shutting off the elevated pressure supply to the rotor risks having the rotor itself being lifted from the base by the applied pressure and detached, and indeed launched as a projectile, as well as uncontrolled discharge of the liquid.

Whereas the construction of centrifugal separator described in the aforementioned patent specification, that is, the separator rotor being mounted on an elongate stationary spindle fixed to the base, makes it possible for the supply pressure per se to lift the rotor completely clear of the spindle the instant that the cover is separated from the base, it will be appreciated that there are many other configurations of axle means for mounting such separation rotor between base and cover which may be more susceptible to such detachment of the rotor by supply pressure. Particularly susceptible is the type of rotor mounting arrangement in which the rotor is located and mounted with respect to each of the base and cover parts by relatively short stub-axle engagement and in which, if the cover is inadvertently removed, there is little to keep the rotor, particularly if spinning, from instantaneously detaching completely from the base.

In some centrifugal separator designs, it may not be possible to provide a valve arrangement in the separator itself to interrupt the liquid supply to the rotor or rotor mounting means, not only increasing the risk of inadvertent removal of the cover but also making it more difficult to provide a physical interlock against cover removal. Furthermore, even when such a valve for interrupting the liquid supply to the rotor mounting means is provided within the separator, it may be inappropriate to arrange for a manual interlock which prevents removal of the cover, or impracticable because of the necessity to manually overcome the interlock each time the valve means is operated, and even when it is intended to remove the cover.

SUMMARY OF THE INVENTION

It is an object of the present invention to provide an improved centrifugal separator with an arrangement for hindering unintentional ejection of the separator rotor.

Another object of the invention is to provide a centrifugal separator with a simple and unobtrusive means of guarding against inadvertent cover removal.

According to the present invention a centrifugal separator of solid contaminants from a liquid supplied thereto at elevated pressure comprises a housing having a base part and a cover part releasably secured with respect to each other and containing a separation rotor, the separation rotor being contained between the base and cover being mounted with respect thereto by spindle means, rotatable about an axis extending between the base and cover and displaceable along the axis limited by said base and cover, the centrifugal separator being characterized by rotor restraining means comprising a restraining surface forming part of, or carried by, the rotor extending radially and circumferentially of the rotor and facing away from the base, and abutment means carried by the base, having an abutment surface overlying the restraining surface at or beyond said limit of axial displacement of the rotor from the base permitted by the cover, operable to prevent further axial displacement of the rotor away from the base in the absence of limitation by the cover.

BRIEF DESCRIPTION OF THE DRAWINGS

The invention will be described in further detail hereinafter with reference to illustrative preferred embodiments shown in the accompanying drawings in which:

FIG. 1(*b*) is a partly cut-away, perspective view of the rotor restraining means of FIG. 1(*a*)

DETAILED DESCRIPTION OF PREFERRED EMBODIMENTS

Figure 1A:
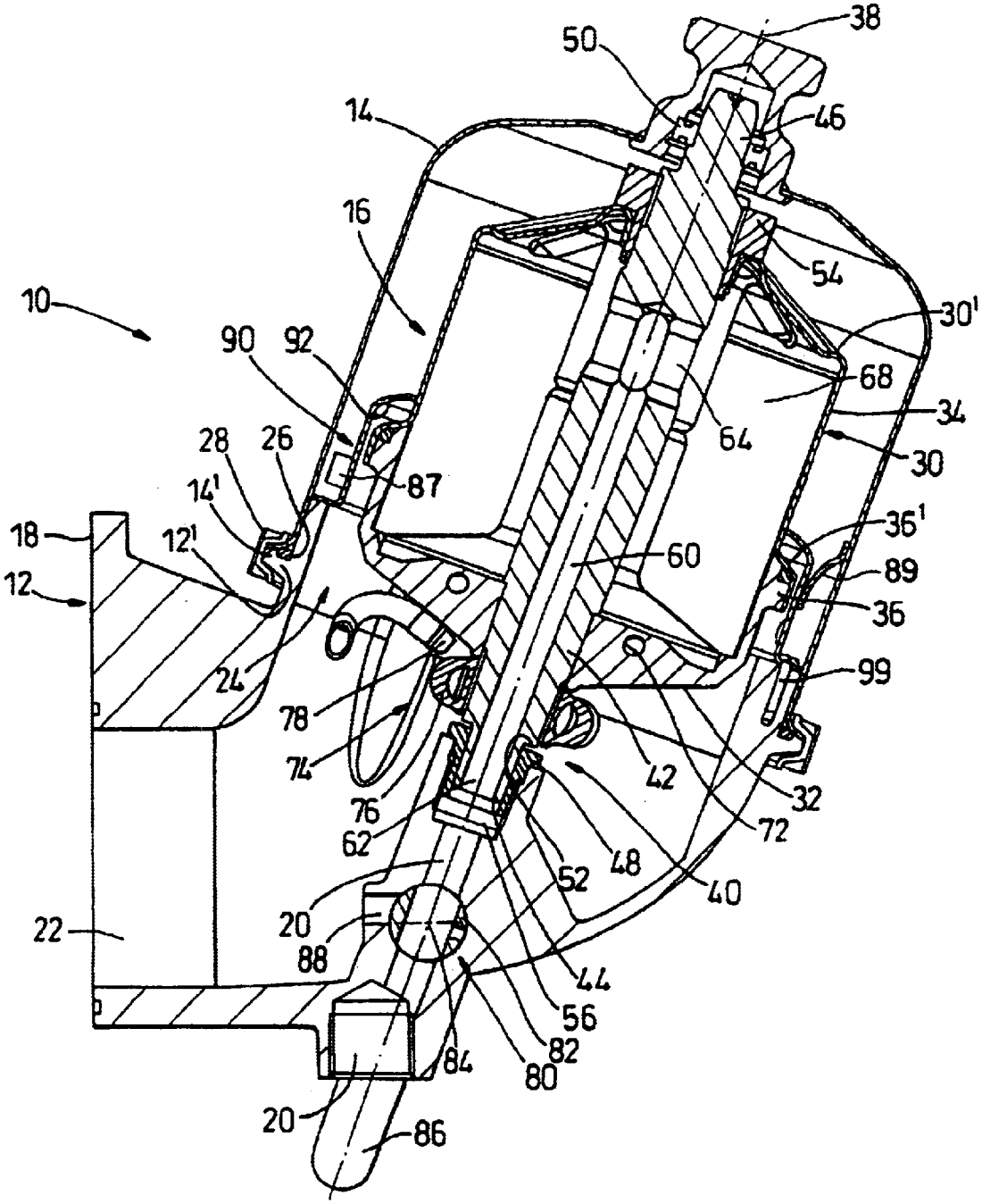
FIG. 1(*a*) is a sectional elevation through a centrifugal separator in accordance with the present invention including a first embodiment of rotor restraining means having an abutment constructed as a flanged, circumferentially complete tubular body.
Figure 1B:
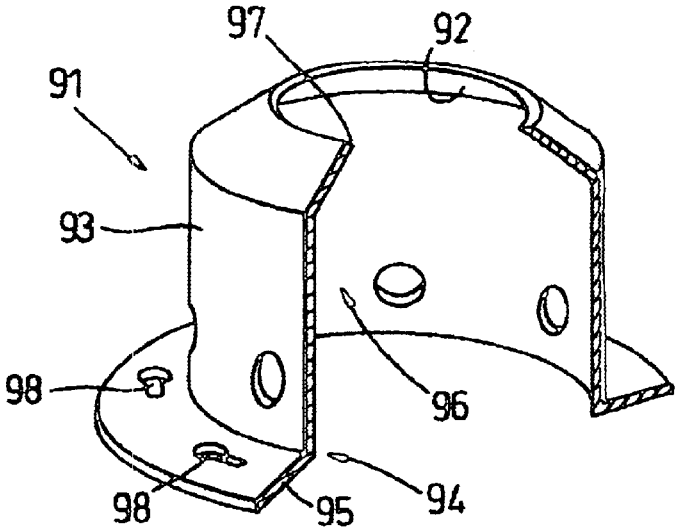

Referring to FIG. 1(*a*), a centrifugal separator 10 comprises a base part 12 and a cover part 14 releasably secured with respect thereto to define a housing enclosure for a separation rotor 16.

The base part 12 is a machined casting having a mounting region 18, liquid supply duct 20, of relatively small cross-section, and a drain duct 22, of relatively large cross-section, which leads to an upwardly facing collection region 24.

The cover part 14 encloses the rotor and collection region, being supported on the base 12 by way of outwardly projecting sealing flanges 14[1] and 12[1] on each respectively and between which is disposed a sealing element 26. The sealing flanges are tapered convergingly in a radial direction and surrounded by a correspondingly profiled, circumferentially discontinuous clamping ring arrangement 28 which is operable, by radial contraction, to provide significant axial force between the flanges and on the sealing element to secure the cover part with respect to the base part.

The separation rotor 16 comprises an annular container 30 of two axially conjoined parts, somewhat similar to the housing. A first component part 32 is disposed adjacent the base 12 and a second component part 34 is disposed adjacent the cover, each being of generally tubular form closed at one end and open at the other, complementing and joined to each other at a peripheral seam 36 which defines a flange extending radially outwardly of, and circumferentially about, the peripheral wall of the rotor between its ends, the flange having an upper surface 36[1] discussed below.

The separation rotor is substantially symmetrical about a longitudinal axis 38 thereof for rotation thereabout, and to this end, the separator 10 also includes, on said axis, rotor mounting spindle means 40 comprising a spindle 42 extending through, and fixed with respect to, the container 30. The spindle extends axially beyond the ends the container in the form of relatively short, effective stub axles, to effect at the lower end a first stub axle 44 and at the upper end a second stub axle 46. The first stub axle part locates in a bearing 48 in the base 12 and the second stub axle locates in a bearing 50 in the cover 14, defining first stub axle means and second stub axle means respectively. The lower end of the spindle is stepped at 52 and with the bearing 48 effects a thrust bearing which inter alia limits axial displacement of the rotor in a downward direction towards the base. The upper end of the spindle carries a thrust bearing bush 54 which is able to bear against the cover and inter alia limit axial displacement of the rotor in an upward direction away from the base, that is, defines a rotor displacement limit. In normal circumstances there is a small amount of axial displacement, or end float, permitted.

The bearing 48 is disposed in a recess 56 in the base 12 which forms a continuation of the supply duct 20, and the spindle 42 has a supply feed passage 60, extending part way therealong from an open lower end 62 in the recess 56, which forms a further continuation of the supply duct 20. The passage terminates at a cross-drilling 64 which communicates with an annular feed chamber 66 of the rotor leading into the container space 68. A separate annular chamber 70 directs liquid from the container space to a plurality of discharge apertures 72 which in turn communicate with the discharge region 24 of the housing.

As an alternative to the more common arrangement of using reaction to emission of the liquid from the discharge apertures via flow constricting nozzles to drive the rotor in rotation, the rotor 16 may be driven by an external turbine arrangement 74 comprising an array of vanes or buckets 76, carried by the spindle 42, and a fixed jet 78 disposed to direct liquid tapped from the supply ducts 20, or from some other source, against the vanes.

The supply duct 20 also, optionally, contains valve means 80 comprising a valve body 82 rotatable about an axis 84, normal to the duct, by operation of handle 86. The valve body has a T-shape through passage and is operable upon rotation to redirect liquid flow along duct 20 by way of diversion passage 88 into the drain duct 22.

The centrifugal separator structure thus so far described, and its operation, is essentially conventional; liquid supplied at elevated pressure to duct 20 passes through valve means 80 and into the spindle passage 60, passing therefrom via the container and discharge apertures 72 to the drain duct 22. Some of the liquid is directed by way of nozzle 78 to impinge upon the spindle-mounted vanes 76 to spin the rotor and permit centrifugal separation of solid contaminants from the liquid that passes through the container space. It will be appreciated that the rotor, full of liquid has a significant weight and to minimize the downward thrust force on the lower bearing 48, the liquid supply pressure is used to exert an axial lifting force on the spindle to compensate therefor.

In normal operation, the valve means 80, or an external equivalent (not shown), would be operated to prevent the supply liquid flow from reaching the rotor spindle before the clamping ring arrangement 28 is released and the cover is lifted from the base and the upper (stub axle) part of the spindle means. It will be understood that if the clamping ring arrangement were to be released without closing the valve, the axial force exerted by the supply pressure on the rotor and cover would lift them away from the base and, in addition to turning one or both into projectiles, would permit the liquid to discharge at high pressure and volume over surrounding machinery and/or personnel, and possibly starving the machinery of needed lubricant liquid with consequential damage thereto.

Referring also to FIG. 1(*b*), in accordance with the present invention the centrifugal separator 10 is provided with rotor restraining means indicated generally at 90. The restraining means is in two parts. One part comprises a restraining surface forming part of, and extending circumferentially of, the rotor, and facing away from the base. This surface is provided by the aforementioned upper flange surface 361 of the rotor seam 36. The other part comprises abutment 91, carried by the base 12, having an abutment surface 92 overlying the restraining surface 361 beyond the normal limit of axial displacement of the rotor from the base (end float) permitted by the cover. The abutment 91 comprises a tubular, that is, circumferentially continuous, body part 93 having, at a first end 94, a radially outwardly directed mounting flange 95 for securing it with respect to the base 12 and, at a second end 96, radially inwardly directed flange means 97 which provides the abutment surface 92.

The nature of the rotor restraining means is that the abutment, by its abutment surface, prevents removal of the rotor from the base without first removing the abutment. To this end, and having regard to the annular nature of the space available between rotor and housing, the abutment is arranged to engage with the base by approach thereto in an axial direction and be secured thereto by rotating the abutment about its axis so that it interlocks in the manner of a bayonet or similar type fitting. As shown, the mounting flange 95 comprises at least one mounting aperture 98 therethrough having a varying radial width circumferentially. Additionally, the base 12 carries a corresponding number of headed fasteners 99 each arranged to pass through a said mounting aperture at the point of greatest radial width but prevented from so doing at the point of least radial width.

It will be appreciated that the precise structure of the abutment and the restraining surface may be open to variation, as desired and to accommodate different design features of the rotor housing. For example, if the rotor does not have a conveniently placed seam at some point on its peripheral wall, the abutment could be dimensioned to have its abutment surface overlying the upper end wall of the rotor (indicated at 30[1]), or one or more flanges of arbitrary extent in the circumferential direction may be secured to the peripheral wall of the rotor or possibly, in the case of a rotating spindle, to the spindle means.

It will be appreciated that provided at least one of the restraining and abutment surfaces is circumferentially continuous, the other one need not be. Therefore, if the restraining surface is circumferentially complete the abutment surface, and indeed other parts of the surface, and indeed the abutment itself, may be circumferentially discontinuous.

Figure 2:
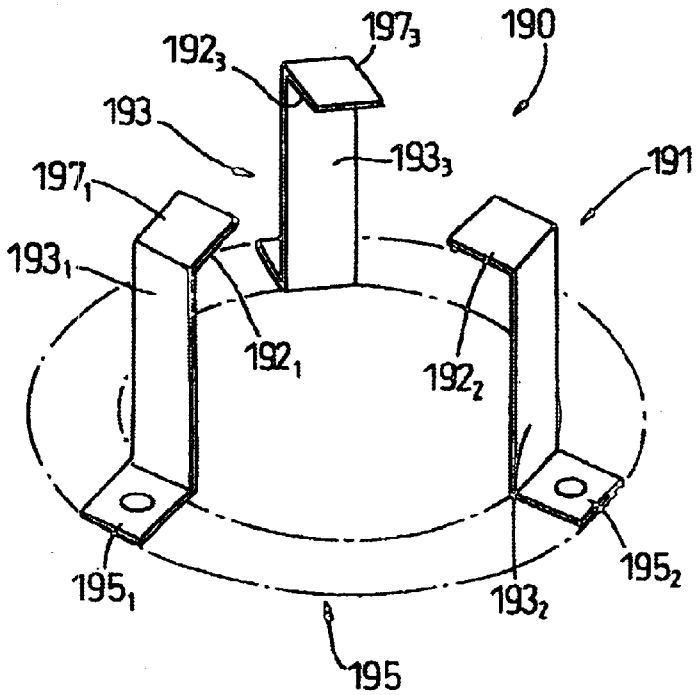
FIG. 2 is a perspective view of the abutment of a second embodiment of rotor retraining means, in which the abutment is constructed in the form of flanged, circumferentially discontinuous fingers.

Referring now to FIG. 2 a second form of rotor restraining means (190) comprises the aforementioned rotor restraining surface 36[1] and abutment 191. The abutment 191 differs from abutment 90 described above in that the abutment surface and axially extending body is discontinuous circumferentially and comprises one or more discrete axially extending fingers $\mathbf{193}_1$, $\mathbf{193}_2$, $\mathbf{193}_3$ each topped by respective flanges $\mathbf{197}_1$. $\mathbf{197}_2$ . . . that define circumferentially limited components $\mathbf{192}_1$, $\mathbf{192}_2$ . . . of abutment surface 193. Mounting flange means 195 maybe discontinuous as a flange $\mathbf{195}_1$, $\mathbf{195}_2$ . . . associated with each finger or may be circumferentially continuous, as shown in broken lines, in the manner of flange 95 for easier manipulation.

It will be appreciated that when the rotor restraining surface 36[1] is tapered, any force it exerts on the abutment surface components has a radial component and the fingers $\mathbf{192}_1$, $\mathbf{192}_2$ . . . should be capable of resisting deflection thereby. However, if the rotor restraining surface does not exert a component of force radially on the abutment, then the fingers may be manually deflectable to permit engaging the rotor with, and removing it from, the base 12. Notwithstanding the form taken by the abutment, it may be secured with respect to the base by other forms of attachment.

It will be appreciated that there is a possibility of the abutment being inadvertently omitted when the cover is secured to the base and for the operator to be unaware that the safety factor of the restraining means is not present and about which, at the very least, the operator should not be complacent. This is particularly so if the optional valve 80 is omitted.

Simple warning means may be included, such as a window 87 in the cover which makes the present or absence of the abutment apparent or a resilient tongue 89 which extends radially inwardly from the peripheral wall of the cover or base to scrape audibly against the rotor unless deflected away therefrom by the abutment, that is, remain silent when the abutment means is in place.

Alternatively, more complex interlock may by provided that inhibits operation of the centrifugal separator without the abutment. Such an interlock may take the form of a valve (not shown) which is linked to the presence of the abutment adjacent the body to permit liquid to bc supplied to the spindle passage, or if the valve 80 is included, such interlock may require the presence of the abutment adjacent the body to permit the valve to be moved from diversion to through-flow status. The interlock may alternatively or additionally take a form that inhibits attachment of the cover to the base in the absence of the abutment. For example, the base may carry a resilient member extending at least in part radially outwardly so that it prevents the cover from moving into engagement with the base, which member has a radially inwardly directed component upon which force is exerted by installation of the abutment to deflect member out of the path of the cover. These should be considered as exemplary only and may be used alone or in conjunction with each other or other methods within the knowledge of the skilled practitioner.

It will be appreciated that the centrifugal separator of the invention is not confined to having the rotor mounting means or rotor drive arrangements described above. The rotor may be driven by more conventional reaction nozzles at container outlet 72 and/or be driven by fluid other than the liquid being cleaned within the rotor container. The rotor mounting means may comprise a stationary spindle fixed with respect to the base, or stationary stub axles fixed with respect to the base and cover.

Although a centrifugal separator in accordance with the invention may benefit particularly from having rotor restraining means when the supply liquid pressure exerts an axial force on the rotor tending to separate it from the base, the provision of such restraining means is beneficial even when the rotor is not susceptible to such forces, in avoiding the liquid spillage consequences of inadvertent normal removal of the rotor.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations falling within the scope of the appended claims and equivalents thereof.

What is claimed is:

1. A centrifugal separator for separating solid contaminants from a liquid supplied thereto at elevated pressure, said separator comprising:

a housing having a base part and a cover part releasably secured to each other, and a separation rotor contained in said housing between the base part and cover parts, said rotor being mounted in said housing by a spindle so as to be rotatable about an axis extending between the base part and cover parts and to be displaceable along the axis between limits defined by said base part and cover parts;

wherein said centrifugal separator further comprises a rotor restraint comprising:

a restraining surface forming part of, or carried by, the rotor and extending radially and circumferentially of the rotor and facing away from the base part, and an abutment carried by the base part and having an abutment surface overlying the restraining surface at or beyond the limit of axial displacement of the rotor from the base part defined by the cover part, said abutment being operable to prevent further axial displacement of the rotor away from the base part if the cover part is removed;

wherein the abutment comprises an axially extending body having, at a first end, a radially directed mounting flange for securing the abutment to the base part of the housing, and, at a second end, a radially inwardly directed flange overlying the restraining surface, and wherein said base part carries at least one fixed holding member and said radially directed mounting flange defines at least one open area through which each said holding member can pass axially when said abutment is in a first rotational position relative to said base part, and said radially directed mounting flange further comprises at least one portion which underlies each said fixed holding member when said abutment is in a second rotational position relative to said base part, whereby said abutment can be secured to said base part by passing the at least one holding member through the at least one open area and then rotating the abutment to said second rotational position.

2. A centrifugal separator according to claim 1, wherein the restraining surface extends circumferentially completely around the rotor.

3. A centrifugal separator according to claim 1, wherein the abutment surface comprises a circumferentially complete annular surface.

4. A centrifugal separator according to claim 1, wherein the restraining surface comprises a flange extending radially outwardly of a peripheral wall of the rotor.

5. A centrifugal separator according to claim 4, wherein the rotor comprises a first component part disposed adjacent the base part of the housing and a complementary second component part disposed adjacent the cover part, said first and second component parts being joined to each other at a peripheral seam defining said flange.

6. A centrifugal separator according to claim 1, wherein the abutment is releasably secured to the base part and removable therefrom to permit removal of the rotor by axial displacement away from the base part.

7. A centrifugal separator according to claim 1, wherein the axially extending body is a tubular, circumferentially continuous body.

8. A centrifugal separator according to claim 7, wherein the abutment is configured to engage the base part by approach thereto in an axial direction and to be secured to the base part by rotation of the abutment about its axis.

9. A centrifugal separator according to claim 1, wherein the spindle which mounts the rotor comprises a first stub axle defined between the base part of the housing and a first end region of the rotor, and second stub axle defined between the cover part of the housing and a second end region of the rotor opposite said first end region.

10. A centrifugal separator according to claim 1, further comprising warning means for providing an indication of the presence or absence of the abutment.

11. A centrifugal separator according to claim 1, wherein the at least one open area comprises at least one mounting aperture having a varying radial width circumferentially, and the at least one fixed holding member comprises a corresponding number of headed fasteners each adapted to pass through the at least one mounting aperture at a point of greater radial width but prevented from passing through at a point of lesser radial width.

12. A centrifugal separator for separating solid contaminants from a liquid supplied thereto at elevated pressure, said separator comprising:

a housing having a base part and a cover part releasably secured to each other, and a separation rotor contained in said housing between the base part and cover parts, said rotor being mounted in said housing by a spindle so as to be rotatable about an axis extending between the base part and cover parts and to be displaceable along the axis between limits defined by said base part and cover parts;

wherein said centrifugal separator further comprises a rotor restraint comprising:

a restraining surface forming part of, or carried by, the rotor and extending radially and circumferentially of the rotor and facing away from the base part, and an abutment carried by the base part and having an abutment surface overlying the restraining surface at or beyond the limit of axial displacement of the rotor from the base part defined by the cover part, said abutment being operable to prevent further axial displacement of the rotor away from the base part if the cover part is removed;

wherein the abutment is releasably secured to the base part and removable therefrom to permit removal of the rotor by axial displacement away from the base part;

wherein the abutment comprises an axially extending body having, at a first end, a radially directed mounting flange for securing the abutment to the base part of the housing, and, at a second end, a radially inwardly directed flange overlying the restraining surface;

wherein the axially extending body is a tubular, circumferentially continuous body;

wherein the abutment is configured to engage the base part by approach thereto in an axial direction and to be secured to the base part by rotation of the abutment about its axis; and wherein the mounting flange has at least one mounting aperture therethrough having a varying radial width circumferentially and the base part carries a corresponding number of headed fasteners each dimensioned to pass through a said mounting aperture at the point of greatest radial width but not at the point of least radial width of the mounting aperture.

* * * * *